US005960233A

United States Patent [19]

Goto et al.

[11] Patent Number: 5,960,233

[45] **Date of Patent: *Sep. 28, 1999**

[54] TEMPERATURE CONTROL FOR A FIXING APPARATUS

[75] Inventors: Masahiro Goto; Takahiro Inoue; Kouichi Suwa, all of Yokohama; Yuko Okama, Tokyo; Satoru Izawa, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,473

[22] Filed: Nov. 25, 1996

Related U.S. Application Data

[63] Continuation of application No. 08/187,906, Jan. 28, 1994, abandoned.

[30] Foreign Application Priority Data

Jan. 29, 1993 [JP] Japan ..... 5-013476

[51] Int. Cl.[6] ..... G03G 15/20

[52] U.S. Cl. ..... 399/69

[58] Field of Search ..... 399/69, 70; 347/156

[56] References Cited

U.S. PATENT DOCUMENTS

| | | | |
|---|---|---|---|
| 3,588,445 | 6/1971 | Hopkins | 355/282 X |
| 4,719,489 | 1/1988 | Ohkubo et al. | 399/45 |
| 4,963,943 | 10/1990 | Tamary | 355/290 |
| 5,040,075 | 8/1991 | Takayanagi | 358/300 |
| 5,264,902 | 11/1993 | Suwa et al. | 355/282 |
| 5,280,328 | 1/1994 | Goto et al. | 355/285 |
| 5,289,247 | 2/1994 | Takano et al. | 355/285 |
| 5,361,088 | 11/1994 | Ito et al. | 346/156 X |

FOREIGN PATENT DOCUMENTS

| | | |
|---|---|---|
| 59-231573 | 12/1984 | Japan . |
| 63-133177 | 6/1988 | Japan . |
| 63-184777 | 7/1988 | Japan . |
| 3-178433 | 2/1993 | Japan . |
| 5-27641 | 2/1993 | Japan . |

*Primary Examiner*—William J. Royer

*Attorney, Agent, or Firm*—Fitzpatrick, Cella, Harper & Scinto

[57] ABSTRACT

A timer for measuring the image formation interval, and the fixing temperature is set in response to the measured image formation interval so as to balance satisfactorily the degree of fixation, the amount of the recording material curling, and the recording material wrinkling no matter what timing is used to start the next image formation after the completion of the preceding one.

7 Claims, 4 Drawing Sheets

TEMPERATURE CONTROL FOR A FIXING APPARATUS

This application is a continuation of application Ser. No. 08/187,906 filed Jan. 28, 1994 now abandoned.

FIELD OF THE INVENTION AND RELATED ART

The present invention relates to an image forming apparatus such as an electrophotographic printer, in particular an image forming apparatus including a fixing device for fixing thermally an image developed on the recording material.

In an image forming apparatus such as an electrophotographic apparatus, an electrostatic recording apparatus, or a like apparatus, a fixing apparatus of a heating roller type is widely used because of its excellent thermal efficiency and also because it is safe. Further, in recent years, a fixing apparatus of a through-film heating type has come to be used because of its fast startup speed, in which film with an extremely small heat capacity is employed in place of the roller.

In such an apparatus as described above in which the image is fixed in a nip by being heated and compressed, fixing temperature, pressure, nip width, and the like become important factors to determine the degree of toner fixation and the amount of the curling of the recording material.

The degree of fixation and amount of curling have a reciprocal relation. In other words, improving one deteriorates the other. More specifically, in order to improve the degree of fixation, it is preferable to raise the surface temperature of the heating roller, to increase the pressure, and to widen the nip width, each of which works in the direction of increasing the amount of curling. Of these three, to raise the surface temperature of the heating roller is the most effective way to curl the recording material.

Therefore, the fixing temperature, pressure, and nip width were selected to keep the reciprocal degrees of fixation and curling within practical ranges.

Further, in the fixing apparatus of these types, the degree of fixation and the curling of the recording material are greatly affected by the temperature of the pressure roller. Since the pressure roller temperature is affected by the time which has elapsed after the power source of the image forming apparatus was turned on or types of sheet delivery modes, it is likely to be easily changed. Particularly when the pressure roller is reduced in diameter and subsequently its thermal capacity becomes small, the temperature changes quickly and drastically; therefore, the degree of fixation and the amount of curling of the recording material are greatly affected or changed by the aforementioned factors. For example, in a mode in which the sheets of recording material are consecutively fed, the amount of heat absorbed from the pressure roller by the recording material is more than that supplied to the pressure roller from the heating roller; therefore, the pressure roller temperature drops, being likely to cause the degree of fixation to deteriorate. On the other hand, in an intermittent printing mode, the amount of heat supplied to the pressure roller from the heating roller is larger, contrarily, than that absorbed by the recording material; therefore, the pressure roller temperature increases, improving the degree of fixation. Generally speaking, in order to deal with the curling of the recording material, a de-curling means is activated immediately after the thermal fixing apparatus. However, the amount of heat received by the recording material is different between the continuous and intermittent printing modes, and, for example, when the de-curling means is activated in a manner suitable to de-curl the recording material in the continuous printing mode by applying a force in a manner to deform the recording material in the direction opposite to the curling, the de-curling effect is likely to become insufficient for the intermittent printing mode, and on the other hand, when the de-curling means is activated in a manner suitable to de-curl the recording material in the intermittent mode, the de-curling effect is too strong for the continuous printing mode, causing thereby the recording material to curl in the opposite direction.

Therefore, it is extremely difficult to balance both requirements, that is, to accomplish a satisfactory degree of fixation while reducing the curling, in all of the various sheet delivery modes.

In a small fixing apparatus of a thermal type, a pressure roller having-an elastic layer with a low level of hardness is likely to be used as the pressure roller. This is to provide a sufficient nip, using a relatively low pressure. Since the elastic layer of this type of pressure roller has a large coefficient of thermal expansion, the external diameter is greatly changed by the pressure roller temperature. Therefore, for example, in many cases in which the pressure roller has been sufficiently heated in the intermittent printing mode, the temperature of the heating roller or heating film is higher in the middle compared to both ends in the longitudinal direction, which makes the pressure roller temperature higher also in the middle. As a result, the diameter of the center portion becomes larger. At this time, the shape of the pressure is a so-called crown shape, which urges the recording material to converge toward the middle section. As a result, less resilient recording material is likely to wrinkle when left under hot and highly humid conditions.

As a means for dealing with such problems, it is effective to pre-shape the pressure roller into a reverse crown shape having a smaller diameter in the middle compared to both ends. However, in this case, the pressure roller fails to build a satisfactory nip in the middle when it has not been sufficiently warmed up; therefore, fixing failure is likely to occur.

SUMMARY OF THE INVENTION

Accordingly, it is a principal object of the present invention to provide a fixing method and apparatus and an image forming method and apparatus using the same, which is capable of fixing the image without curling of the recording material.

It is another object of the present invention to provide a fixing method and apparatus and an image forming method and apparatus using the same, which is capable of fixing the size without creasing the recording material.

It is a further object of the present invention to provide a fixing method and apparatus and image forming method and apparatus using the same, which is capable of fixing the image without curling and creasing the recording material.

According to the present invention, there is provided an image forming apparatus including an image forming device for forming an unfixed image on a recording material; a fixing device provided with a heating member for fixing the unfixed image on the recording material, being maintained to keep a predetermined temperature, and a rotary pressing member for forming a nip in cooperation with said heating member. The said apparatus further including a measuring device for measuring image formation intervals; and a temperature setting device for setting the fixing temperature in response to the image formation intervals measured by the measuring device.

These and other objects, features and advantages of the present invention will become more apparent upon a consideration of the following description of the preferred embodiments of the present invention taken in conjunction with the accompanying drawings.

BRIEF DESCRIPTION THE DRAWINGS

DESCRIPTION OF THE PREFERRED EMBODIMENTS

Hereinafter, embodiments of the present invention will be described.

Embodiment 1

Figure 1:
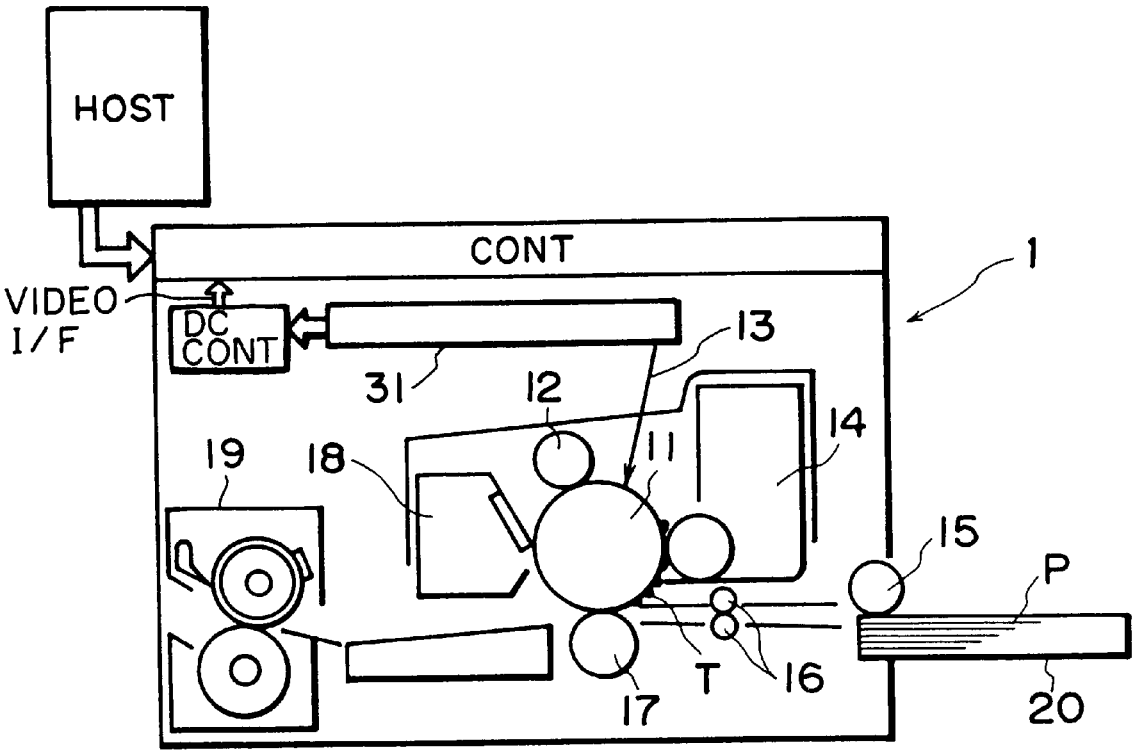
FIG. 1 is a sectional view of a preferred embodiment of the image forming apparatus according to the present invention.

FIG. 1 is a schematic section of the first embodiment of the image forming apparatus according to the present invention, a laser printer. The laser printer 1 in this embodiment is connected to a host such as a personal computer or a work station, receiving the imaging data from the host and developing them into bit map data with the use of a controller. The imaging data developed into the bit map data are sent through a video interface to the engine portion of the laser beam printer 1. The engine portion scans, in a manner of raster-scanning, an image forming surface, with the laser beam modulated in response to the imaging data, whereby a desired image is created. At this time, the controller and the engine portion of the laser beam printer 1 communicate in the following manner through the video interface. First, on receiving a signal from the controller, the engine portion starts up for getting ready for the sheet delivery and printing operation, and when ready, sends out a ready signal. Next, after confirming the presence of the ready signal being sent out from the engine portion, the controller sends a print signal, a sheet feed signal, to the engine portion. Receiving this print signal, the engine portion immediately feeds out a recording material P from a recording material storage such as a cassette 20 and delivers it to a registration roller 16, with the use of a feed roller 15. The recording material P is temporarily held at the register roller 16, remaining on standby until the engine portion becomes ready to write an image after the startup operations of the scanner 31, a motor (unshown, being contained within the scanner 31), and the completion of the preparatory rotation (so-called pre-rotation) for stabilizing the potential of a photosensitive drum 11. Then, the engine portion sends out a vertical synchronization request signal (VSREQ), indicating that the engine portion is ready for image writing. Receiving this signal, the controller sends out to the engine portion a vertical synchronization signal (VSYNC), and also imaging signals (VIDEO) after a predetermined delay. After receiving the VSYNC, the engine portion delivers the recording material from the registration roller 16 to a transferring station.

Next, the image formation in the laser beam printer will be described. After being uniformly charged to the negative polarity by the charging means such as a charging roller 12, the photosensitive drum 11 with a photosensitive layer made of organic photoconductive material (OPC) or the like is illuminated by the laser beam 13 modulated in response to the aforementioned imaging signals, whereby a desired electrostatic latent image is obtained. This electrostatic latent image is developed by a developing apparatus 14 containing negatively charged toner, to be visualized as a toner image T. The toner image T is electrostatically transferred onto the recording material P by a transferring means like a transfer roller 17, and then, the recording material P is delivered to a fixing apparatus 19 of the heat roller type, by which the toner image is permanently fixed. The residual toner on the photosensitive drum 11 is cleaned by a cleaner 18. Then, the same image forming process is repeated. In the image forming portion of the apparatus, the developing apparatus 14, charging roller 12, photosensitive drum 11, and cleaner 18 are assembled into a single structure, forming an exchangeable cartridge for the main assembly.

Figure 2:
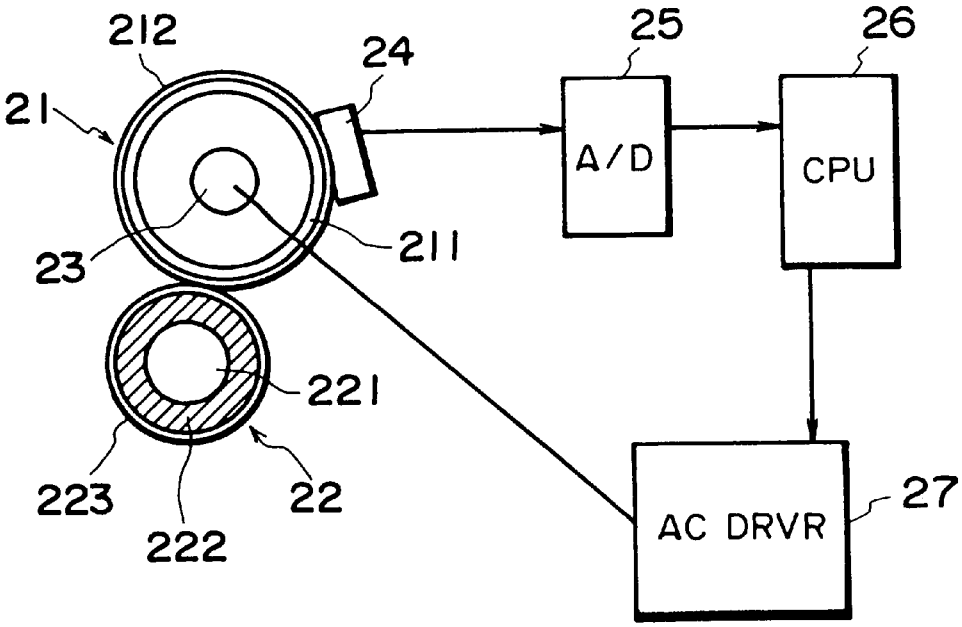
FIG. 2 is an enlarged sectional view of the fixing apparatus of the embodiment shown in FIG. 1.

FIG. 2 is a schematic section of the heat roller type fixing apparatus applicable to the present invention. A heat roller 21 comprises a metallic core 211 made of Al, Sus, or the like and a layer of fluorinated resin 212 such as PTFE (tetrafluoroethylene), PFA (tetrafluoroethylene-perfluoroalkylether copolymer) covering the metallic core 211. The pressure roller 22 comprises a metallic core 221 of Sus, iron, or the like, an elastic layer 222 of silicone rubber, silicone sponge, or the like, covering the metallic core 221, and a PFA tube, coating the elastic layer 222. The heat roller 21 is heated by a heating member such as a halogen heater 23 provided within the heat roller 21, and on the surface of the heat roller 21, a temperature detecting element such as a thermistor 24 is provided. The signal from the heat roller 21 is sent to a CPU through an A/D converter 25. In response to this signal, the CPU 26 turns on or off the heater 23 through an AC driver 27, so that the surface temperature of the heat roller 21 is controlled to be kept at a predetermined temperature.

Figure 3:
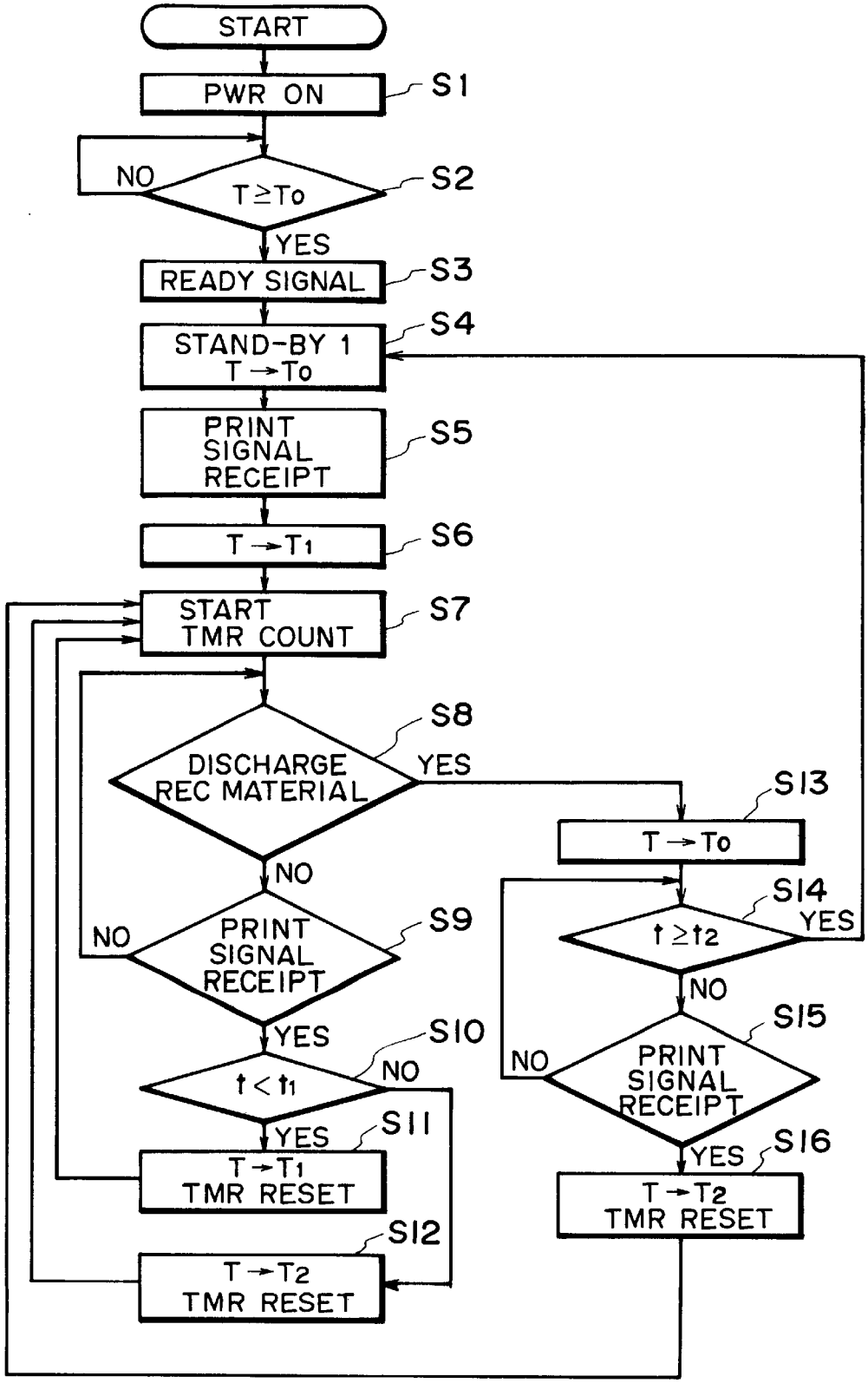
FIG. 3 is a flow chart for describing the embodiment of the present invention.

FIG. 3 is a flow chart for describing the operation of the first embodiment of the present invention. After the power source is turned on (S1), it is detected in the engine portion of the laser printer 1 whether or not the surface temperature T of the heat roller has reached a temperature $T_0$ (S2), and when it is detected that $T_0$ has been reached, a ready signal indicating that the engine is ready to print is sent out (S3). Next, the engine portion remains on standby, keeping the heat roller temperature at $T_0$ until it receives a print signal (S4). After receiving the print signal (S5), the engine portion initiates the operations for feeding the recording material, printing the image, or the like, and at the same time, begins to rotate the heat roller and pressure roller; to raise the surface temperature T of the heat roller from $T_0$ to $T_1$ (S6); and to count the time, on receiving the signal (S7). While the printing operation continues, the engine portion is ready to receive the next print signal until the completion of the recording material discharge (S8, S9), and when the next print signal is received before the recording material rotating or moving with the heat roller and pressure roller is discharged out of the thermal fixing apparatus or the image forming apparatus, a time t which has elapsed after the reception of the previous print signal is monitored (S10). When this time t is shorter than a predetermined duration $t_1$, the surface temperature T of the heat roller is maintained at $T_1$, and at the same time, a timer is reset (S11), beginning again to count the time t until next print signal is received (S7). When, in S10, the time t is longer than $t_1$, the surface temperature T of the heat roller is lowered to $T_2$ which is lower than $T_1$, and at the same time, the timer is reset (S12), beginning again to monitor the time t till next print signal is received.

When the print signal is not received before the completion of the recording material discharge, that is, before the time when the rotation of the heat roller and pressure roller is stopped (S8), the surface temperature T of the heat roller is lowered to $T_0$, and the engine enters the standby period (S13). However, the time t is continuously monitored until next print signal is received (S14, S15). When the time t is shorter than the second predetermined time $t_2$ which is longer than $t_1$, the surface temperature T is controlled to become $T_2$, and at the same time, the timer is reset (S16), beginning again to monitor the time t until next print signal is received (S7). When, in S14, the time t necessary for the next print signal to be received exceeds $t_2$, the counting by the timer is interrupted, and the engine restores the condition of immediately after the ready signal has been received (S4).

More specifically, during the on-going printing operation and the post-rotation of the heat roller and pressure roller, the pressure roller temperature, which drops as the recording material absorbs the heat, recovers.

During the on-going printing operation, when it is determined that the time t is shorter than the first predetermined duration $t_1$, it is determined that the pressure roller is not sufficiently warm, as it is not during the continuous printing operation, and the surface temperature of the heat roller is maintained at $T_1$ which is slightly higher. Next, when the time t needed for the next print signal to be received is longer than $t_1$, it is determined that the pressure roller is sufficiently warm, as it is during the intermittent printing operation, and the surface temperature T of the heat roller is maintained at $T_2$ which is lower than $T_1$.

After the completion of the on-going printing operation, the temperature of the pressure roller keeps on dropping during the standby period in which the heat roller and pressure roller are not moving.

Even after the completion of the on-going printing operation, the time t is continuously monitored until next print signal is received, wherein when the next print signal is received before the second predetermined time $t_2$, being longer than $t_1$, elapses, it is determined that the pressure roller is still sufficiently warm and the surface temperature T of the heat roller is maintained at $T_2$; and when the time t is longer than $t_2$, it is determined that the pressure roller has cooled down; therefore, the counting by the timer is interrupted, and the engine restores the initial conditions existing immediately after the ready signal is transmitted.

By monitoring the intervals of print signals and changing the target temperature of the heat roller in response to the monitored duration of the intervals, the temperature of the heat roller can be controlled to be lower when the pressure roller is sufficiently warm, as it is during the intermittent printing operation, in which the degree of fixation is excellent, without provision of a means for detecting the temperature of the pressure roller; therefore, the curling of the recording material can be reduced, and further, the wrinkling of the recording material, which is likely to occur under hot and highly humid conditions, can be prevented.

Next, the operation and effects of this embodiment will be further described in detail referring to practical examples. As for the heat roller 21, a roller having an external diameter of 25 mm was used, which comprised a metallic core of 1 mm thick Al and a 30 $\mu$m thick PFA layer coated on the core metal. As for the pressure roller 22, a roller having an external diameter of 20 mm and a hardness of 50 degrees (ASCARC hardness meter, 500 g load) was used; the roller comprised an iron core having an external diameter of 10 mm, a 5 mm thick elastic layer of silicone rubber, having a rubber hardness of 15 degree (JISA) and covering the iron core, and PFA tube (50 $\mu$m thick) covering the elastic layer. The laser beam printer in which the thermal fixing apparatus of this embodiment was used had an image forming speed of 50 mm/sec and outputted eight pieces of A4 size prints per minute.

In the thermal fixing apparatus with the above described structure, the standby temperature $T_0$ was set at 170° C.; slightly higher temperature $T_1$ during the on-going printing operation, at 185° C.; and the slightly lower temperature $T_2$ during the on-going printing operation was set at 175° C. The first duration $t_1$ for the print signal intervals was predetermined to be 15 seconds, and the second duration $t_2$ was predetermined to be five minutes.

With such settings established, when the print signal interval was less than 15 seconds, the surface temperature of the heat roller 21 was controlled to be 185° C., and at that time, the degree of fixation (5 mm square solid black image was rubbed by non-woven fabric, with a pressure of 40 g/m$^2$, and the degree of fixation was expressed in percentage as a ratio of density loss=$(D_0-D_1)/D_0\times100$, wherein $D_0$ was the density before rubbing and $D_1$ was the density after rubbing) slightly deteriorated as the print signal interval became shorter and the sheet counts increased but remained within 10%. The amount of curling at that time (immediately after being discharged into the discharge tray and taken out of the tray, the recording material was placed on a horizontal surface and the maximum distance between the surface and recording material was defined as the amount of curling) was worst when the print signal interval was 15 seconds, but in the cases of most of the various types of paper, it remained within 15 mm. When the print signal interval was 15 second or more but less than five minutes, the temperature of the heat roller 21 was controlled to be 175° C. The degree of fixation at that time was worst when the print signal interval was 15 seconds or five minutes, but even under that worst condition, it remained below 15%. The amount of curling at that time became largest when the print signal interval was 25 to 45 seconds, but in the cases of most of the various types of paper, it remained below 15 mm.

As a comparative sample, the surface temperature of the heat roller was controlled to be always 185° C. during the printing operation. At that time, the degree of fixation remained below 10% regardless of the sheet delivery modes, but the amount of curling exceeded 25 mm when the print signals were sent in every 25 to 45 seconds. Contrarily, when the surface temperature of the heat roller was fixed at 175° C. during the printing operation, the amount of curling remained below 15 mm in any of the sheet delivery modes, but the degree of fixation sometimes exceeded 20% when the print signal interval was less than nine seconds. Since the degree of fixation less than 20% and the amount of curling less than 20 mm are considered to create no practical problem, it is evident that the temperature control according to this embodiment can satisfy the balance between the degree of fixation and amount of curling in any of the sheet delivery modes, which was difficult to accomplish with use of the prior temperature control.

As for the wrinkling of the recording material under hot and highly humid conditions, paper was left under hot and highly humid conditions of 35° C. and 80% for more than 24 hours, but the wrinkles did not appear in any of the sheet delivery modes when the temperature control according to this embodiment was adopted. On the other hand, when the surface temperature of the heat roller was controlled to be always 185° C., as it was by the prior temperature control, the wrinkles sometimes appeared when the print signal interval was 20 to 50 seconds.

In order to obtain such effects as described in the foregoing, setting a proper time for switching the target temperature becomes essential. For example, when the first predetermined duration $t_1$ is too short, the degree of fixation deteriorates as the target temperature is switched to a lower temperature, and when it is excessively long, the amount of curling increases while the target temperature is higher. On the other hand, when the second predetermined duration $t_2$ is excessively short, the amount of curling increases as the target temperature is switched to a higher temperature, and when it is too long, the degree of fixation deteriorates while the target temperature is lower. As a result of intensive studies, this inventors discovered that the optimal ranges for the durations $t_1$ and $t_2$ were dependent on the image forming speed $V_P$ (mm/sec) of the image forming apparatus and the external diameter $D_P$ (mm) of the pressure roller.

As the results of a number of experiments involving the above-mentioned parameters, the following relation was obtained:

With regard to the shorter duration $t_1$, $$22.5 \cdot D_P/V_P \leqq t_1 \leqq 50 \cdot D_P/V_p (\text{sec})$$

has only to be satisfied, and with regard to the longer duration $t_2$, $$0.12 \cdot D_P \leqq t_2 \leqq 0.7 \cdot D_P (\text{min})$$

has only to be satisfied.

In regard to the wrinkling of the recording material, the effects of the temperature control according to the present invention was manifested most clearly when the hardness of the pressure roller was below 60 degrees (ASKERC, 500 g load).

With the parameters set as described in the foregoing, and also the application of the temperature control according to the present invention, the amount of the recording material curling and the degree of fixation were satisfactorily balanced, and so were the wrinkling and the degree of fixation. Further, in the printer of this embodiment, in order to determine when the target temperature is to be switched, the time elapsing after the reception of the print signal is continuously monitored even during the on-going printing operation, so even when the printer is capable of accepting another print signal anytime even during the on-going printing operation, the target temperature can be flexibly switched to deal with a number of printing commands or print counts selected with various timings by the users; therefore, the curling, the wrinkling, and the degree of fixation are satisfactorily balanced without inconveniencing the user.

Embodiment 2

Figure 4:
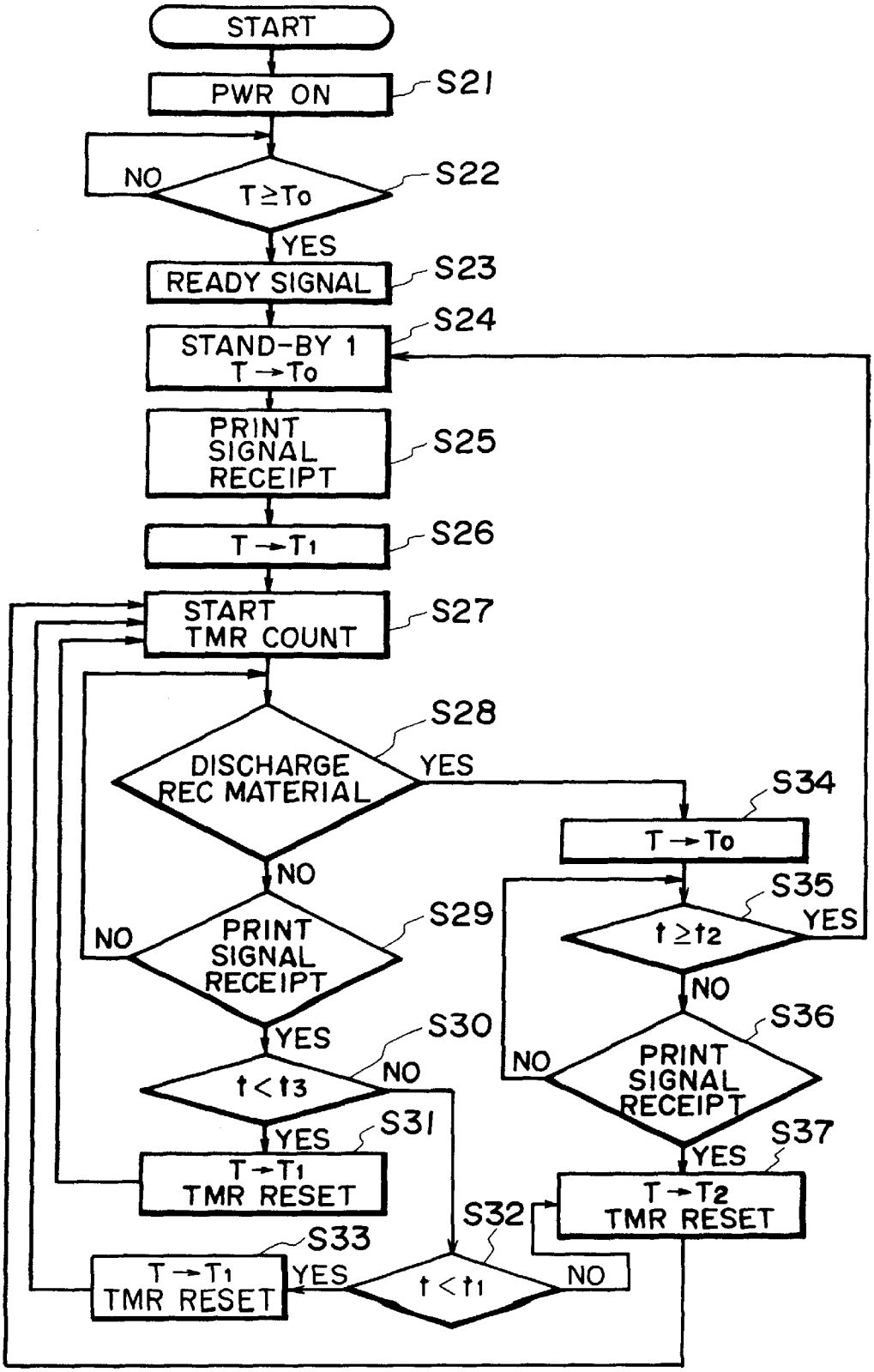
FIG. 4 is a flow chart for describing an alternative embodiment of the present invention.

FIG. 4 is a flow chart for describing the temperature control of an alternative embodiment of the present invention. The laser printer 1 and thermal fixing apparatus to which this embodiment is applicable are the same as those in the first embodiment; therefore, their descriptions will be omitted.

In this embodiments, the temperature of the heat roller is controlled to be set even higher at a temperature $T_3$ when the print interval is shorter, whereby occurrence of such a phenomenon as described with regard to the preceding embodiment that the degree of fixation deteriorates as the print signal interval becomes shorter and the print counts increases can be prevented.

Referring to the flow chart in FIG. 4, the sequence from S21 to S30 is the same as the preceding embodiment and its description will be omitted.

When next print signal is received during the on-going printing operation in which the heat roller and pressure roller are rotating, the surface temperature T of the heat roller is switched to the highest target temperature $T_3$ if the print interval is shorter than the shortest predetermined duration $t_3$, and at the same time, the timer is reset (S31), beginning again to monitor the time t it takes for next print signal to be received (S27); and is switched to $T_1$ (S33) as it was in the first embodiment if the print interval t is longer than $t_3$ but shorter than $t_1$ (S32). With regard to other modes, the operations are the same as the first embodiment; therefore, their descriptions will be omitted.

By controlling the temperature in this manner, not only the same effects as the preceding embodiment can obtained, but also such a phenomenon that the degree of fixation deteriorates as the print interval becomes shorter and the sheet delivery counts increases can be suppressed. Further, the temperature for the first print can be set lower when the timer counting is started; therefore, the amount of curling can be further reduced for the printing mode for printing only a single print, which is the most frequently used mode.

Next, the operation and effects of this embodiment will be described more specifically. The temperature control according to this embodiment is applied to the same laser printer and thermal fixing apparatus as the preceding embodiment. The standby temperature $T_0$ was set at 170° C.; the temperature for the first print, at 180° C.; the slightly higher temperature $T_3$ during the on-going printing operations, at 190° C.; and the slightly lower temperature $T_2$ during the on-going printing operation was set at 170° C. The first duration $t_1$ was predetermined to be 15 seconds; the second duration $t_2$, five minutes; and the shortest duration $t_3$ was predetermined to be 10 seconds.

With the parameters set as described in the foregoing, the degrees of fixation remained below 5% when the print interval was short (less than 10 seconds). When the print interval was 10 seconds, the curing of the recording material was worst, being yet less than 15 mm. In most of the other modes, the degrees of fixation were less than 10% and also the amounts of curling were less than 15 mm, as they were in the preceding embodiment. Further, the amount of curing of the first print (when the print interval was more than five minutes) was less than 10 mm, which was smaller compared with the preceding embodiment.

By switching the target temperature in smaller steps in response to the print interval of the recording material, the amount of the recording material curling can be reduced while improving the degree of fixation.

Embodiment 3

Figure 5:
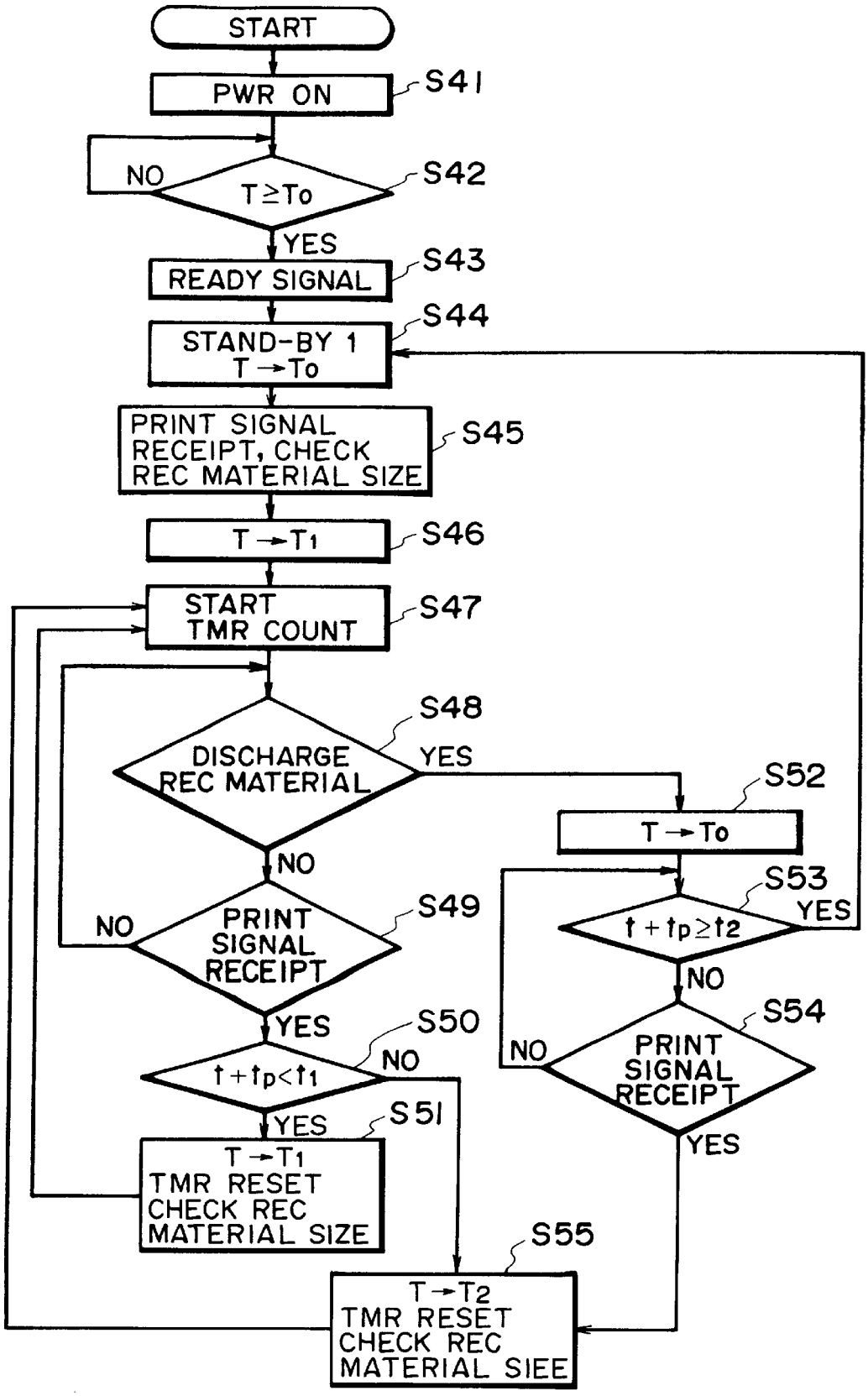
FIG. 5 is a flow chart for describing another alternative embodiment of the present invention.

FIG. 5 is a flow chart for describing another alternative embodiment of the present invention.

The laser beam printer and thermal fixing apparatus to which this embodiment is applied are the same as those in the first and second embodiment; therefore, their descriptions will be omitted.

In this embodiment, the size of the recording material is monitored, and the target temperature is switched in response to the recording material size and the print interval, whereby the temperature can be more precisely controlled in response to the various recording material sizes and sheet delivery modes.

Referring to FIG. 5, the sequence from S41 to S44 is the same as the preceding embodiment; therefore, its description will be omitted. In S41, the recording material size is checked at the same time as when the print signal is received (for example, a size signal from the sheet feeder cassette, or the like, is used). At this time, the surface temperature T of the heat roller is raised from $T_0$ to $T_1$ (S46), and at the same time, the timer is started to monitor the print interval (S47). When next print signal is received during the on-going printing operation (S49), a corrective time tp predetermined in correspondence with the recording material size is added to the time t counted by the timer. When this corrected time is shorter than the first predetermined duration $t_1$ (S50), the surface temperature T of the heat roller is maintained at $T_1$; at the same time, the time is reset; and the size of next printing material is checked (S51), and then, the timer again begins a new count (S47). In S50, when t+tp is longer than the first predetermined duration $t_1$, the surface temperature T of the heat roller is lowered to $T_2$; the timer is reset; at the same time, the recording material size for next printing is checked (S55). When the print signal is received after the completion of the on-going printing operation, steps S52 to S55 of tof the flow chart are followed. At this time, the surface temperature T of the heat roller is lowered to the standby temperature $T_0$, wherein when the print signal is received while the sum t+tp of the print interval t and the corrective time tp in correspondence with the recording material size is shorter than the second predetermined duration $t_2$ (S54), the surface temperatures T of the heat roller is controlled to rise to the temperature $T_2$ and the printing operation is carried out. When the sum t+tp of the print interval t and the corrective time tp in correspondence with the recording material size is longer than the second predetermined duration $t_2$, the operation returns to the standby 1 of immediately after the printer engine has warmed up (S44), wherein counting the time necessary for next print signal to arrive is interrupted. After the completion of the on-going printing operation, there will be no problem even if no correction is made using the corrective time tp since the corrective time tp in correspondence with the recording material size is sufficiently small compared with $t_2$.

Next, a method for setting the corrective time tp in correspondence with the recording material size will be described. The time during which the recording material is in the thermal fixing apparatus varies in correspondence with the recording material size; the longer the recording material size is, the shorter the time during which the heat roller and pressure roller are directly in contact with each other becomes, reducing the amount of the heat given to the pressure roller. On the other hand, when the recording material size is shorter, the opposite to the above statement can be said to be true. Therefore, by determining the corrective time tp in correspondence with the recording material size, in particular the length, the time during which the heat roller and pressure remain directly in contact with each other becomes constant in practical terms regardless of the length of the recording material. In this embodiment, an A4 size sheet (210 mm wide×297 mm long) was used as a reference, in relation with which the corrective time tp is determined for the recording material size Lp (mm), with the image forming speed Vp (mm/sec). For example, in the case of an A5 size sheet (148 mm×210 mm), the difference in length 297 mm−210 mm=87 mm, and the corrective time tp is: tp=87/Vp (second).

When this is expressed in a generalized form:

$$tp=(297-Lp)/Vp$$

Generally speaking, the recording material size is fixed; therefore, the corrective time may be set for each size as shown in Table 1, and these numerical values may be stored in the ROM of the CPU to be read as needed when the recording material size is checked.

TABLE 1

(Image formation speed Vp = 50 mm/sec)

| | B5 | A5 | A4 | Letter | Legal | Executive |
|---|---|---|---|---|---|---|
| tp (sec) | 0.8 | 1.74 | 0 | 0.5 | 1.26 | 0.61 |

As was described in the foregoing, in this embodiment, the time during which the heat roller and pressure roller rotate, being directly in contact with each other with a predetermined contact pressure, can be monitored in practical terms; therefore, more precise temperature control can be carried out in response to the temperature changes of the pressure roller. In other words, the optimum temperature control can be carried out to match the recording material size and sheet delivery modes, making it possible to balance satisfactorily the degree of fixation, the amount of curling, and the wrinkling.

Further, monitoring the recording material size in addition to monitoring the print interval during the on-going printing operation as it is done in this embodiment becomes a remarkably effective temperature controlling means when applied to the printer or the like of a type which is used by a number of users and is capable of not only receiving the print command even during the on-going printing operation but also then accepting a print command for a different recording material size.

As described hereinbefore, according to the present invention, no matter what timing is used to start the image formation after the completion of the preceding image formation, a proper temperature control can be carried out; therefore, the degree of fixation, the amount of curling, and the wrinkling can be satisfactorily balanced.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image forming means for forming an unfixed image on a recording material, said image forming means starting an image forming operation after input of a printing signal;

fixing means having a heating member for fixing the unfixed image on the recording material, being maintained to keep a fixing temperature during an image fixing operation, and a back-up member for forming a nip in cooperation with said heating member; and temperature changing means for changing the fixing temperature in accordance with an interval of printing signals.

2. An apparatus according to claim 1, further comprising:

a recording material accommodating portion, and feeding means for feeding the recording material from said accommodating portion, wherein said feeding means starts feeding in response to input of the printing signal.

3. An apparatus according to claim 1, wherein said temperature changing means sets a higher temperature when the interval is shorter.

4. An apparatus according to claim 1, wherein said temperature changing means sets the fixing temperature at a first temperature when the interval of printing signals is shorter than a predetermined interval, and said temperature changing means sets the fixing temperature at a second temperature which is lower than the first temperature when the interval of printing signals is larger than the predetermined interval.

5. An apparatus according to claim 1, further comprising interval detecting means for detecting an input interval of the printing signals.

6. An apparatus according to claim 5, wherein said interval detecting means counts a time period after input of a first printing signal.

7. An apparatus according to claim 5, further comprising correcting means for correcting a value detected by said interval detecting means in accordance with a size of the recording material.

* * * * *

UNITED STATES PATENT AND TRADEMARK OFFICE

CERTIFICATE OF CORRECTION

PATENT NO. : 5,960,233

DATED : September 28, 1999

INVENTOR(S): MASAHIRO GOTO, ET AL.

It is certified that error appears in the above-identified patent and that said Letters Patent is hereby corrected as shown below:

COLUMN 2:
Line 17, "having-an" should read --having an--; and
Line 63, "said" should be deleted.
COLUMN 4:
Line 66, "till" should read --until--.
COLUMN 6:
Line 31, "second" should read --seconds--.
COLUMN 7:
Line 13, "this" should read --these--; and
Line 58, "embodiments," should read --embodiment,--.
COLUMN 9:
Line 17, "tof" should be deleted.

Signed and Sealed this

Thirteenth Day of June, 2000

*Attest:*

Q. TODD DICKINSON

*Attesting Officer*

*Director of Patents and Trademarks*